United States Patent [19]

Sowell

[11] Patent Number: 4,712,317

[45] Date of Patent: Dec. 15, 1987

[54] ATHLETIC SHOE

[76] Inventor: Gene H. Sowell, 528 Devon St., Seymour, Tenn. 37865

[21] Appl. No.: 910,075

[22] Filed: Sep. 22, 1986

[51] Int. Cl.[4] ..... A43B 5/02; A43B 5/00

[52] U.S. Cl. ..... 36/133; 36/132

[58] Field of Search ..... 36/133, 128, 132, 136, 36/114, 107, 135, 71, 71.5

[56] References Cited

U.S. PATENT DOCUMENTS

| | | | |
|---|---|---|---|
| 2,782,531 | 2/1957 | Frazier et al. | 36/2.5 |
| 2,796,684 | 6/1957 | Montgomery | 36/2.5 |
| 3,114,982 | 12/1963 | McGowan | 36/132 |
| 3,191,321 | 6/1965 | Brutting | 36/2.5 |
| 3,218,734 | 11/1965 | O'Brien | 36/2.5 |
| 3,650,051 | 3/1972 | Sass | 36/2.5 |
| 3,851,410 | 12/1974 | Frazier | 36/2.5 |
| 4,065,861 | 1/1978 | Pelfrey | 36/133 |
| 4,073,075 | 2/1978 | O'Brien | 36/127 |
| 4,123,856 | 11/1978 | Lawson | 36/133 |
| 4,149,324 | 4/1979 | Lesser | 36/127 |
| 4,204,346 | 5/1980 | Fugere | 36/114 |
| 4,422,249 | 12/1983 | Hannah | 36/133 |
| 4,442,615 | 4/1984 | Danks | 36/133 |

FOREIGN PATENT DOCUMENTS

| | | | |
|---|---|---|---|
| 3314274 | 10/1983 | Fed. Rep. of Germany | 36/128 |
| 18195 | of 1892 | United Kingdom | 36/128 |

*Primary Examiner*—Werner H. Schroeder
*Assistant Examiner*—Steven N. Meyers
*Attorney, Agent, or Firm*—Luedeka & Neely

[57] ABSTRACT

An athletic shoe having a generally planar ball-impacting surface formed in the recessed part of the instep and/or lateral aspect regions of the shoe. When formed in the instep region, for example, the surface extends across the region between the curvilinear heel and toe end portions of the shoe and includes at least two adjacent discrete sections separately attached to or integrally formed with the outer surface of the instep region of the shoe. The sections are disposed in sliding contact, one with respect to the other, and configured so that when the toe portion of the shoe is flexed upwardly, the sections slide with respect to each other while maintaining the ball-impacting surface in a substantially planar configuration.

7 Claims, 5 Drawing Figures

ATHLETIC SHOE

FIELD OF THE INVENTION

The present invention relates to athletic shoes and more particularly relates to an athletic shoe for kicking a ball such as a soccer ball or a football, the shoe having a planar ball-impacting surface disposed across the instep and/or lateral aspect region of the shoe.

BACKGROUND OF THE INVENTION AND PRIOR ART

In athletic shoes used in sports involving kicking of balls and the like, the configuration of the shoe can greatly influence the accuracy, repeatability, and distance of the kicks. Examples of attempts to modify the shoe configuration for this purpose or add accessories specifically designed therefore are illustrated in U.S. Pat. Nos. 2,782,531; 2,796,684; 3,650,051; 3,851,410; 4,065,861; and 4,123,856. These patents show various alterations of the toe portion for placekicking and the vamp portion for punting, and are primarily concerned with athletic shoes for use in the game of football which is played with an oblong ball, pointed at opposite ends, where kicking of the ball is typically accomplished using only the toe or vamp portion of the shoe.

In the game of soccer, a round ball is used and essentially the entire shoe surface is employed in kicking the ball. An important soccer kick is the lateral kick and is ordinarily executed using the side of the shoe adjacent the ball of the foot and the instep region of the shoe. Lateral kicks are also occasionally executed using the outside surface or lateral aspect region of the shoe. Heretofore, soccer shoes have been constructed to substantially conform to the shape of the foot and thus present curved or rounded surfaces adjacent the instep and lateral aspect regions of the shoe. These curved or rounded surfaces in turn present an essentially infinite number of possible directions from which a soccer ball may proceed when kicked using the area of the shoe adjacent the instep or lateral aspect regions. As a consequence, great individual skill and dexterity has been required to effect accurate, repeated kicks having the desired distance from the side regions of the shoe. Known soccer shoes have lacked any adequate provision for improving the repeatability, accuracy, and distance of kicks made using the instep or lateral aspect regions of the shoe. As a result, novices, beginners, and even accomplished players find it difficult or impossible to execute quality kicks of this type.

In the game of football, the so-called "soccer style" kick has become widely used by placekickers and is executed by striking the ball with the instep region of the shoe. The problems noted above with regard to soccer shoes have also been experienced by placekickers since football shoes have recessed instep regions and curved surfaces adjacent the regions like soccer shoes.

A need therefore exists for an athletic shoe for use in kicking balls which is adapted to improve the accuracy and repeatability of kicks executed using the instep or lateral aspect regions of the shoe. A further need exists for a shoe of the character described which increases the distance of kicks executed using these regions of the shoe over that obtainable with conventional athletic shoes. A more specific need exists for an athletic shoe of the type described which is capable of accomplishing the aforementioned functions during flexing or contortion of the shoe such as that experienced during running, jumping, and stretching attendant the game activities.

SUMMARY OF THE INVENTION

The present invention meets the above needs and others, and according to a preferred embodiment includes an improvement in athletic shoes of the type used in kicking a ball and having an upper attached to a sole, curvilinear heel and toe end portions at opposite longitudinal ends of the shoe, a recessed instep region on one lateral side of the shoe and a lateral aspect region on the other lateral side of the shoe, both the instep region and lateral aspect region being defined by curved surfaces and located generally intermediate the heel and toe end portions. The improvement comprises means defining a generally planar ball-impacting surface on the shoe generally disposed on the surfaces of at least one of said instep and lateral aspect regions and configured to maintain the ball-impacting surface in a generally planar configuration during flexing of the shoe. In the preferred embodiment, the ball-impacting surface extends substantially tangentially to the curvature of both the heel and toe end portions of the shoe at opposite longitudinal ends of the instep region and therefore presents a substantially planar surface across the major portion of the lateral side of the shoe. As a consequence, at a given foot orientation, a ball kicked from essentially any point along the surface will proceed therefrom in substantially the same direction as it would from any other location on the surface. This greatly improves the accuracy and repeatability of kicks made from the instep region of the shoe and reduces the spin on the ball that has typically occurred when the ball was kicked from the rounded surfaces adjacent the instep region of the shoe.

According to another aspect of the invention, the structure defining the ball-impacting surface comprises at least two adjacent discrete portions separately attached to or integrally formed with the surface of the shoe adjacent the instep region thereof and disposed in sliding contact relation, one with respect to the other, so that the portions move in relation to each other when the shoe is flexed along the adjacency of the portions. This substantially prevents formation of wrinkles or other surface contortions in the ball-impacting surface when the shoe is flexed so that accurate kicks can be made even with the shoe in a flexed configuration such as during running, jumping, and the like attendant the normal game activities.

These and other aspects and advantages of the present invention will become apparent upon consideration of the following detailed description when considered in conjunction with the accompanying drawings in which:

DESCRIPTION OF THE PREFERRED EMBODIMENTS

Figure 3:
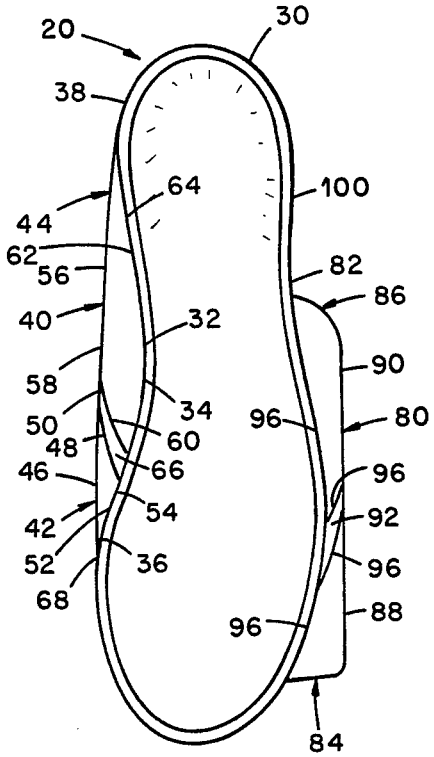
FIG. 3 is a bottom view of the shoe shown in FIG. 1 with an additional generally planar ball-impacting surface illustrated on the lateral aspect region of the shoe.

Referring now to the drawings in which like reference characters designate like or similar parts throughout the several views, an athletic shoe 20 in the form of a soccer or football shoe is illustrated incorporating features of a preferred form of the present invention. In general, the shoe 20 is of a conventional type including an upper 22 and a sole 24 which may support a plurality of depending cleats 26. Between curvilinear or rounded toe heel end portions 28 and 30, the shoe 20 further includes a recessed instep region 32. An outer surface or sidewall 34 of the instep region 32 extends between rounded lateral side surfaces 36 and 38 of the toe and heel ends 28 and 30. In a manner described more fully below, a generally planar ball-impacting surface 40 is defined in the instep region 32 and is preferably disposed substantially tangentially with respect to the previously mentioned rounded lateral surfaces 36 and 38 as shown in FIG. 3.

The ball-impacting surface 40 is preferably provided by discrete front and back members 42 and 44, respectively, which are separately attached to the outer surface of the shoe 20 as will be described. Although in the preferred embodiment, only two members are used, it will be understood that any suitable number may be employed if desired. Also, while the members 42 and 44 are preferably attached to the surface of the shoe 20, they may be integrally formed with the shoe such as where the shoe is constructed using an upper of a moldable material like plastic or rubber rather than the more conventional leather material.

The front member 42 includes an outer, generally planar face 46 which meets with an angular face 48 so as to form a tapered back edge 50. As best seen in FIG. 3, the angular face 48 faces in the direction of the sidewall 34 and extends forwardly towards the toe end 28 of the shoe 20 from the edge 50. The face 48 meets an inside surface 52 of the member 42 which is shaped to substantially correspond to the shape of the portion of the rounded surface 36 adjacent which the member 42 is disposed. The member 42 is attached to the rounded surface 36 of the toe end 28 along its inside surface 52 such as through the use of a layer 54 of suitable adhesive or other suitable means.

The back member 44 includes an outer, generally planar face 56 disposed in substantially the same plane as that of the outer face 46 of the front member 42. At a forward edge 58 of the face 56, an angular face 60 of the back member 44 proceeds in a forwardly direction complimentarily disposed in relation to the angular face 48 of the front member 42. The angular face 60 terminates at the forwardmost end of an inside surface 62 of the back member 44 shaped to substantially correspond to the shape of the sidewall 34. The back member 44 is attached to the sidewall 34 and to a portion of the rounded surface 28 at the heel end 30 of the shoe such as through the use of a layer 64 of adhesive disposed between the inside surface 62 and the indicated surface of the shoe 20, or by other suitable means.

Figure 1:
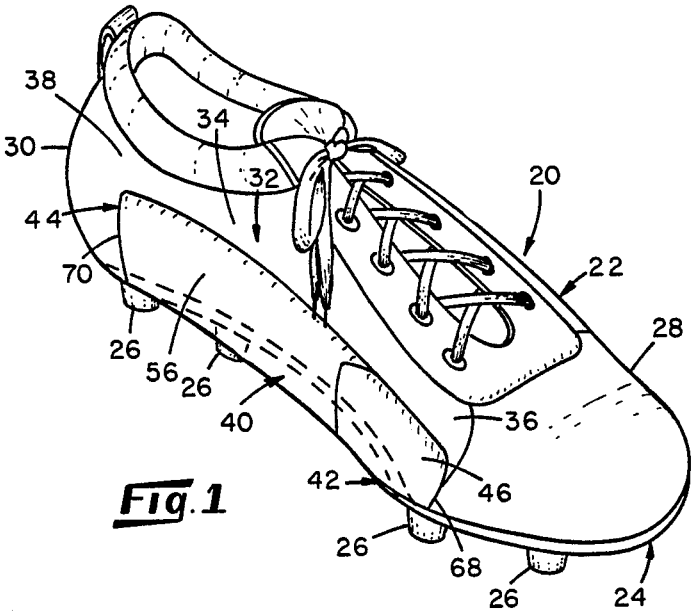
FIG. 1 is a perspective view of a left soccer shoe showing structure defining a generally planar ball-impacting surface in the instep region of the shoe according to a preferred form of the present invention.
Figure 2:
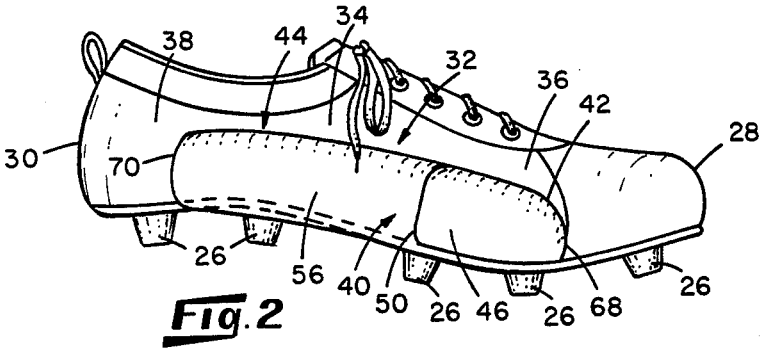
FIG. 2 is a side view of the shoe shown in FIG. 1.

In the preferred form of the shoe 20, a slight angle exists between the angular faces 48 and 60 of the members 42 and 44 when the shoe is in a non-flexed condition such as shown in FIGS. 1 through 3. As a consequence, a space 66 separates the faces 48 and 60 in this condition, although the back edge 50 of front member 42 is in substantial contact with the forward edge 58 of the face 56 of the back member 44 so that no opening exists on the ball-impacting surface 40 adjacent the space 66.

A forward tapered edge 68 of the front member 42 is preferably attached to the rounded surface 36 so as to establish the previously described tangential disposition of the ball-impacting surface 40 with the rounded surface 36. A rearward tapered edge 70 of the back member 44 is preferably similarly configured and disposed.

Figure 4:
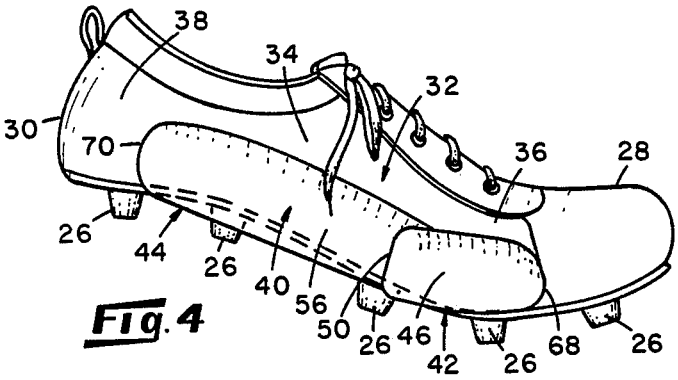
FIG. 4 is a side view of the shoe shown in FIG. 1 in a flexed configuration illustrating relative movement of discrete portions of the ball-impacting surface during flexing of the shoe.
Figure 5:
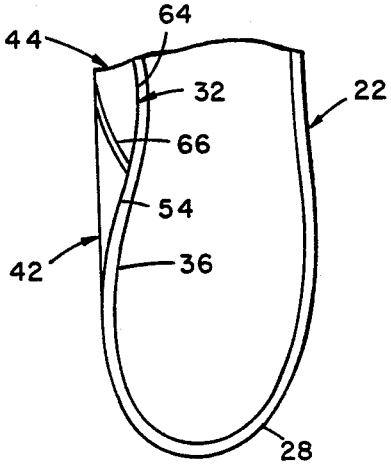
FIG. 5 is a fragmentary bottom view of the shoe flexed as shown in FIG. 4.

Flexing the shoe 20 as shown in FIGS. 4 and 5 causes the front and back members 42 and 44 to move in relation to one another to assume an angular relationship when viewed from the side. This occurs since the front member 42 is attached to the toe end 28 and the back member 44 is attached to the heel end 30 which undergo angular disposition during the type of flexing shown. Also, the ball-impacting surface 40 is maintained in a substantially planar configuration since the members 42 and 44 are separated and the space 66 allows the front and back members 42 and 44 to move towards each other without being compressed or with very little compression. (Compare the size of the space 66 in FIGS. 3 and 5.) This substantially eliminates the occurrence of wrinkles or other distortions on the ball-impacting surface 40. The above-described sliding contact interface between the members 42 and 44 therefore enables accurate, repeatable lateral kicks from the surface 40 whether the shoe 20 is in a flexed or non-flexed position configuration.

The members 42 and 44 are preferably formed of a rubberized plastic material of the type typically used in manufacturing soles for soccer and football shoes, and the like, although it is understood that other suitable materials can be used. In manufacturing the members 42 and 44, a single piece may be molded to a shape corresponding to the overall shape of both and then cut diagonally in a predetermined location or locations to form separate pieces having the angular faces 48 and 60 previously described, which faces are finished by a suitable means to permit easy sliding. The adhesive used to form the layers 54 and 64 may be a hot melt or a silicon rubber adhesive material, or any other suitable type which is substantially impervious to fluid and which forms a secure, long-lasting bond between the members 42 and 44 and the outer surfaces of the upper material of the shoe 20. Sewing or other means may be employed to augment the attachment.

A generally planar ball-impacting surface 80 may also be disposed on the outer side surface or lateral aspect region 82 of the shoe 20, one form of which is illustrated in FIG. 3. Basically, the surface 80 may be constructed in substantially the same manner as the ball-impacting surface 40 previously described in the instep region 32. Consequently, the surface 80 may be defined by a pair of front and back members 84 and 86 which are shaped on their inside surfaces to substantially correspond to the shape of the lateral aspect region 82 adjacent which they are attached and present outer, generally planar surfaces 88 and 90, respectively. A wedge-shaped space 92 is defined between respective opposed angular faces 94 and 96 of the members 84 and 86 directed rearwardly so as to provide the previously described sliding contact therebetween when the shoe 20 is flexed adjacent the space 92. The outer surfaces 88 and 90 remain substantially coplanar whether the shoe 20 is in a flexed or non-flexed configuration to provide the benefit of a continuously available generally planar ball-impacting surface during all the game activities.

The members 84 and 86 may be attached to the surface of the lateral aspect 82 by means of layers 94 and 96 of a suitable adhesive which may be further augmented by sewing.

Like the ball-impacting surface 40 in the instep region 32, the surface 80 is preferably defined in a substantially vertical plane although moderate inclinations thereof may, of course, be provided as desired. Also, while the surface 80 is defined adjacent the toe end 24 of the shoe 20, it is understood that the surface 80 may be defined adjacent the heel end 30 as well such as in the slightly recessed area 100 just forward of the heel end 30, or in any other location on the lateral aspect 82 desired. And while the surface 80 is shown in the manner of a protuberance, it may also be defined in a plane that is substantially tangent with the rounded surfaces surrounding a recessed region on the lateral aspect 82 such as the region 100 previously mentioned. In a similar respect, the ball-impacting surface 40 in the instep region 32 may be defined at other locations on the inside surface of the shoe 20 so as to constitute a protuberance there as well although it is preferred to locate the surface 40 in the instep region 32 as described.

Having thus fully described preferred embodiments of the invention, one of the principal advantages afforded thereby is the ability to minimize erratic kicks from the side regions of conventional athletic shoes due primarily to the curved or rounded surfaces defining the regions. In the past, these curved surfaces, together with the variability of the foot orientation, have made it extremely difficult to execute accurate, repeatable kicks since the effect of a slight change in the foot orientation has been compounded by an alteration in the configuration of the surface of the shoe striking the ball. The flat ball-engaging surfaces 40 and 80 of the present invention in the instep region 32 and on the lateral aspect 82 greatly reduce the influence of foot orientation on the direction of a ball kicked from adjacent these areas. While some degree of skill must be used, it is much less than had been previously required. As a result, the game is more enjoyable and satisfying to novices and beginners who often experience difficulty in executing lateral kicks. Moreover, due to the sliding contact and relative movement between the members comprising the surfaces 40 and 80, accuracy is not significantly affected when kicks are executed with the shoe 20 in a flexed configuration.

Another advantage offered by the present invention is reduction in spin on the ball which has always been a problem in lateral kicks due to the tangential contact between the ball and the curved or rounded surfaces adjacent the side surfaces of the shoes. Lateral kicks executed using a shoe having the features of the present invention may be effected without significant spin when the foot is oriented to impart maximum force to the ball. Thus, distance is increased along with accuracy. Of course, spin can be imparted to the ball by properly orienting the foot but spin is much easier to control since the curved or rounded surfaces of the shoe are eliminated.

Although particular embodiments of the present invention have been illustrated and described in the foregoing detailed description, it will be understood by those of ordinary skill in the art that the invention is capable of numerous modifications, substitutions, and rearrangements without departing from the scope and spirit of the claims below.

What is claimed:

1. In an athletic shoe for use in kicking a ball and having an upper attached to a sole, generally curvilinear heel and toe end portions at opposite longitudinal ends of the shoe, a recessed medial portion on one side of the shoe and a lateral portion on the other side of the shoe, both the medial portion and the lateral portion being defined by curved surfaces and located generally intermediate the heel and toe end portions, the improvement comprising means defining a planar ball-impacting surface on the shoe generally vertically disposed on the surfaces of at least one of said medial and lateral portions and configured to maintain said ball-impacting surface in a substantially planar configuration during flexing of the shoe.

2. The improvement of claim 1, wherein said means defining said ball-impacting surface is configured so that said surface is substantially tangentially disposed in relation to the curvature of said toe and heel end portions.

3. In an athletic shoe for use in kicking a ball and having an upper attached to a sole, generally curvilinear heel and toe end portions at opposite longitudinal ends of the shoe, a recessed medial portion on one side of the shoe and a lateral portion on the other side of the shoe, both the medial portion and the lateral portion being defined by curved surfaces and located generally intermediate the heel and toe end portions, the improvement comprising means defining a generally planar ball-impacting surface on the shoe generally vertically disposed on the surfaces of at least one of said medial and lateral portions and configured to maintain said ball-impacting surface in a substantially planar configuration during flexing of the shoe, said surface defining means comprising at least two adjacent discrete portions separately attached to the surface of the shoe adjacent said medial portion and disposed in sliding contact relation, one with respect to the other, so that said portions move in relation to each other when the shoe is flexed along the adjacency of said portions.

4. In an athletic shoe for use in kicking a ball and having an upper attached to a sole, generally curvilinear heel and toe end portions at opposite longitudinal ends of the shoe, a recessed medial portion on one side of the shoe and a lateral portion on the other side of the shoe, both the medial portion and the lateral portion being defined by curved surfaces and located generally intermediate the heel and toe end portions, the improvement comprising means defining a generally planar ball-impacting surface on the shoe generally verticially disposed on the surfaces of at least one of said medial and lateral portions and configured to maintain said ball-impacting surface in a substantially planar configuration during flexing of the shoe, said surface defining means comprising a first ball-impacting member attached along at least a portion of its length to the surface of said medial portion adjacent said heel end portion and configured to provide a first section of said ball-impacting surface, a second ball-impacting member disposed adjacent said first ball-impacting member and attached along at least a portion of its length to the shoe adjacent said toe end portion and configured to provide a second section of said ball-impacting surface disposed substantially coplanar with said first section, and a sliding contact interface between said first and second ball-impacting members configured so that relative sliding movement of said members is accomplished while maintaining said first and second sections in said substantially coplanar relationship, whereby flexing the shoe adjacent said sliding contact interface causes said first and second ball-impacting members to slide in relation to one another along said sliding contact interface to maintain said first and second sections of said ball-impacting surface in a substantially coplanar relationship.

5. In an athletic shoe for use in kicking a ball and having an upper attached to a sole, generally curvilinear heel and toe end portions at opposite longitudinal ends of the shoe, a recessed medial portion on one side of the shoe and a lateral portion on the other side of the shoe, both the medial portion and the lateral portion being defined by curved surfaces and located generally intermediate the heel and toe end portions, the improvement comprising means defining a generally planar ball-impacting surface on the shoe generally verticially disposed on the surfaces of at least one of said medial and lateral portions and configured to maintain said ball-impacting surface in a substantially planar configuration during flexing of the shoe, said means defining said ball-impacting surface comprising first and second discrete ball-impacting members disposed adjacent said heel and toe end portions, respectively, each of said members having a generally planar outer surface disposed in a generally coplanar relationship with the outer surface of the other member, a sliding contact interface between said members, a space formed between said members adjacent said sliding contact interface, and said members being attached along an inner surface thereof to the outer surface of the shoe adjacent said medial portion.

6. The improvement of claim 5, wherein said sliding contact interface is disposed in a direction proceeding away from the outer surface of the shoe and towards said heel end portion.

7. In an athletic shoe for use in kicking a ball and having an upper attached to a sole, generally curvilinear heel and toe end portions at opposite longitudinal ends of the shoe, a recessed medial portion on one side of the shoe and a lateral portion on the other side of the shoe, both the medial portion and the lateral portion being defined by curved surfaces and located generally intermediate the heel and toe end portions, the improvement comprising means defining a planar ball-impacting surface on the shoe generally verticially disposed on the surfaces of at least one of said medial and lateral portions and configured to maintain said ball-impacting surface in a substantially planar configuration during flexing of the shoe, said ball-impacting surface being defined on the lateral portion of the shoe as a protuberance thereon and being disposed forwardly on the lateral portion adjacent the toe end portion of the shoe.

* * * * *